US008225872B2

(12) United States Patent
Johnson

(10) Patent No.: US 8,225,872 B2
(45) Date of Patent: Jul. 24, 2012

(54) GAS HANDLING IN A WELL ENVIRONMENT

(75) Inventor: Ashley B. Johnson, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1172 days.

(21) Appl. No.: 11/550,875

(22) Filed: Oct. 19, 2006

(65) Prior Publication Data

US 2008/0093083 A1 Apr. 24, 2008

(51) Int. Cl.
*E21B 43/00* (2006.01)

(52) U.S. Cl. ..... 166/369; 166/177.7

(58) Field of Classification Search ..... 166/105, 166/105.5, 177.7, 370, 369
See application file for complete search history.

(56) References Cited

U.S. PATENT DOCUMENTS

| | | | | |
|---|---|---|---|---|
| 3,861,471 | A * | 1/1975 | Douglas | 166/369 |
| 4,386,653 | A * | 6/1983 | Drake | 166/105 |
| 4,531,584 | A | 7/1985 | Ward | |
| 4,749,034 | A | 6/1988 | Vandevier | |
| 5,653,286 | A | 8/1997 | McCoy | |
| 5,961,282 | A | 10/1999 | Wittrisch | |
| 6,167,965 | B1 | 1/2001 | Bearden et al. | |
| 6,357,530 | B1 | 3/2002 | Kennedy | |
| 6,361,272 | B1 | 3/2002 | Bassett | |
| 7,343,967 | B1 * | 3/2008 | Floyd | 166/68.5 |
| 2006/0169457 | A1 | 8/2006 | Ramachandran | |

FOREIGN PATENT DOCUMENTS

| | | | |
|---|---|---|---|
| EP | 0917905 | A1 | 5/1999 |
| EP | 0699270 | B1 | 10/2001 |
| EP | 0917905 | B1 | 1/2004 |
| GB | 2376250 | A | 12/2002 |
| WO | 03076811 | A1 | 9/2003 |
| WO | 2006068530 | A1 | 6/2006 |

* cited by examiner

*Primary Examiner* — Cathleen Hutchins
(74) *Attorney, Agent, or Firm* — Jim Patterson

(57) ABSTRACT

A technique is provided to facilitate movement of fluids in wells where the fluids have a relatively high gas-to-liquid ratio. A submersible pump is combined with a separate, dedicated mixer. The dedicated mixer is positioned upstream of the components of the submersible pump designed to move the well fluid. The mixer reduces large gas structures and homogenizes the fluid flow fed into the submersible pump.

3 Claims, 3 Drawing Sheets

GAS HANDLING IN A WELL ENVIRONMENT

BACKGROUND

In many well environments, gases can build up and interfere with the production of desired liquids. Hydrocarbon based liquids, for example, can be produced by electric submersible pumping systems that are deployed within a wellbore. These types of pumping systems utilize centrifugal pumps having multiple stages that rely on impellers to move the produced liquid. However, the presence of sufficient gas in the liquid can lead to a buildup of gas on the suction surface of impeller blades, causing premature stalling of the individual stages. Furthermore, the relatively high gas-to-liquid ratio fluids can create large gas structures along the exterior of the pumping system that ultimately interfere with the production of well fluid.

Furthermore, system modeling has indicated that operation of an electric submersible pumping system in a wellbore can create multiple (meta) stable states that have substantially differing production rates. It is likely that flow transients, e.g. flow instabilities or perturbations, trigger the transition between these high and low productivity states.

Attempts have been made to prevent premature stall and to dampen flow oscillations so as to enhance the stability of system performance. For example, impeller blade angles have been reduced and holes have been drilled through impeller blades in multiple pump stages of submersible pumps. However, such approaches limit the performance and efficiency of the pumping system.

SUMMARY

In general, the present invention provides a technique for facilitating the pumping of fluids in wells that have a relatively high gas to liquid ratio. A submersible pump is combined with a separate, dedicated mixer positioned upstream of the submersible pump components that move the well fluid. The mixer is designed to reduce large gas structures and to homogenize the fluid flow fed into the submersible pump.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for facilitating the pumping of fluids in a well. A submersible pumping system is deployed in a wellbore and combines a submersible pump with a separate, dedicated mixer upstream of the components pumping the well fluid. For example, the dedicated mixer may be located upstream of the multiple stages of a centrifugal pump used in an electric submersible pumping system. The dedicated mixer can be used to minimize the size of gas pockets, e.g. bubbles, within the pumping system by creating a mixing region within the dedicated mixer able to break apart the gas pockets. Alternatively or in addition, the dedicated mixer can be used to draw down gas structures external to the pumping system. For example, the dedicated mixer can be positioned to draw in gas from gas structures that build up in the annulus surrounding the pumping system. The gas is thoroughly mixed with liquid passing through the dedicated mixer to a submersible pump.

Figure 1:
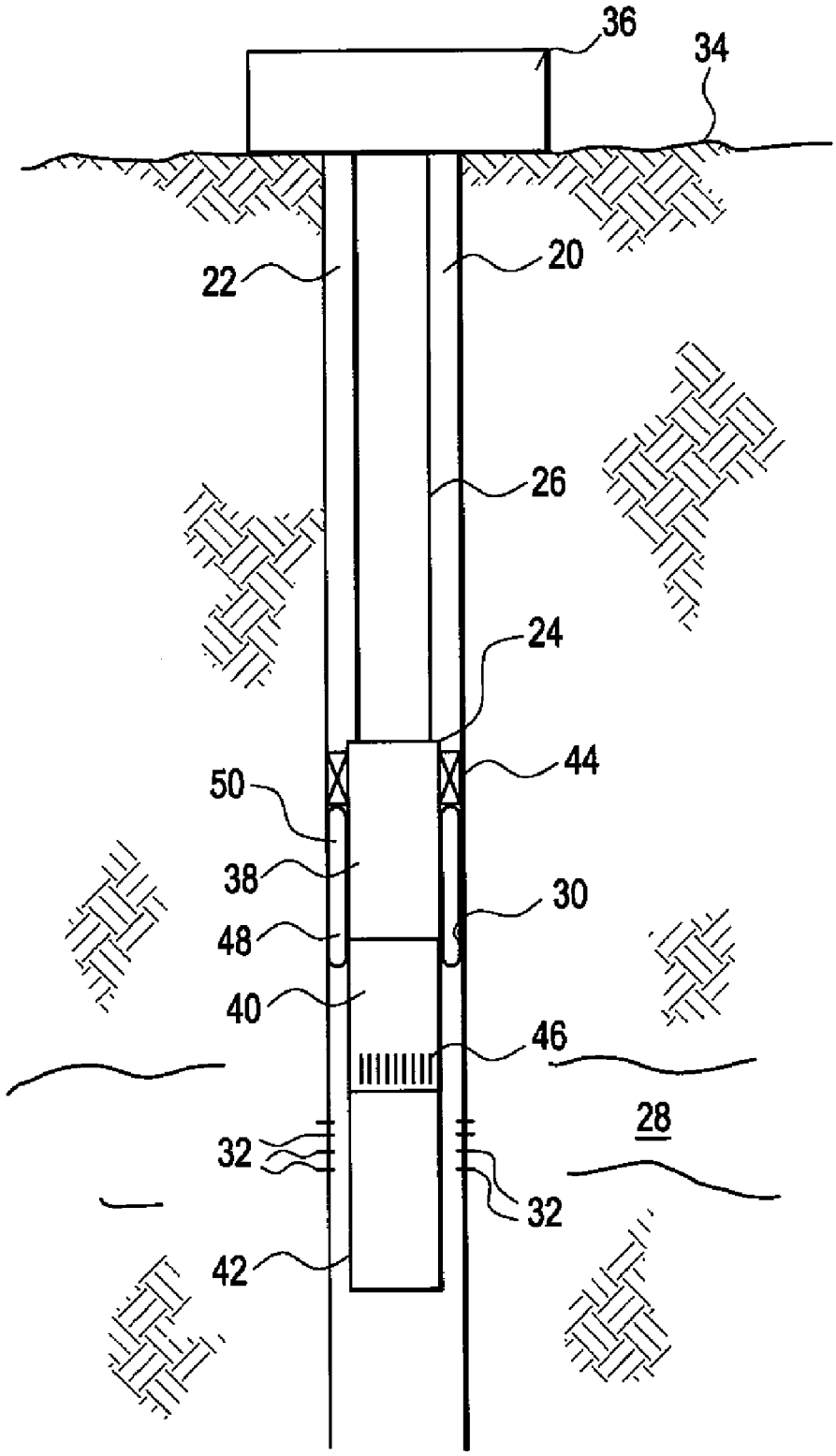
FIG. 1 is a front elevation view of a pumping system deployed in a wellbore and having a dedicated mixer, according to an embodiment of the present invention.

Referring generally to FIG. 1, an embodiment of a well system 20 is illustrated as installed in a wellbore 22. In this embodiment, well system 20 comprises a pumping system 24 deployed by an appropriate deployment system 26. Depending on the pumping system application and the design of pumping system 24, deployment system 26 may comprise coiled tubing, production tubing, cable or other suitable deployment systems. The pumping system 24 is designed for placement in wellbore 22 proximate a geological formation 28 containing desirable production fluids, such as petroleum or other desired fluids. The wellbore 22 typically is drilled and can be lined with a wellbore casing 30. Perforations 32 are formed through wellbore casing 30 to enable the flow of fluids between geological formation 28 and wellbore 22.

The wellbore 22 extends downwardly from a surface 34 which may be the surface of the earth or a seabed floor. Although wellbore 22 is illustrated as generally vertical, the wellbore also can be formed as a deviated wellbore depending on the type of well environment or well application in which system 20 is utilized. In the example illustrated, well system 20 extends down into wellbore 22 from a wellhead 36.

In the embodiment of FIG. 1, pumping system 24 comprises a submersible pump 38 and a separate, dedicated mixer 40 deployed on the upstream side of submersible pump 38. Pumping system 24 also may comprise additional components, e.g. component 42, depending on the type of pumping system utilized in a given application. Additionally, regions of wellbore 22 may be isolated by one or more packers, such as packer 44 positioned above mixer 40. In a fluid production operation, the pumping system 24 is moved downhole to a desired location within a wellbore 22, and packer 44 is set against the surrounding wellbore wall, e.g. casing 30.

Mixer 40 is particularly beneficial when used in producing fluids that have a relatively high gas-to-liquid ratio. For example, in the production of petroleum, mixer 40 greatly facilitates production of fluids tending to have higher gas-to-oil (GOR) ratios that can otherwise hinder efficient production of the wellbore fluid. When submersible pump 38 is operated, fluid is drawn from wellbore 22 through an intake region 46 that may be formed as part of dedicated mixer 40. As fluid moves into mixer 40 through intake region 46, gas pockets, e.g. bubbles, can be drawn into mixer 40 with the fluid.

Additionally, a portion of the gas phase can be separated from the liquid phase as the fluid is drawn through intake region 46. The separated gas phase rises along an annulus 48 surrounding pumping system 24 and can become trapped under, for example, packer 44. As this gas accumulates, a relatively large gas structure 50 is formed beneath packer 44. If this gas structure becomes sufficiently large, it can interfere with the intake of liquid through intake region 46 and further degrade the operation of pumping system 24. However, dedicated mixer 40 is designed to provide a simple, inexpensive tool that can be used to remove gas from gas structure 50 and/or minimize the gas pockets drawn into mixer 40 through intake region 46.

Figure 2:
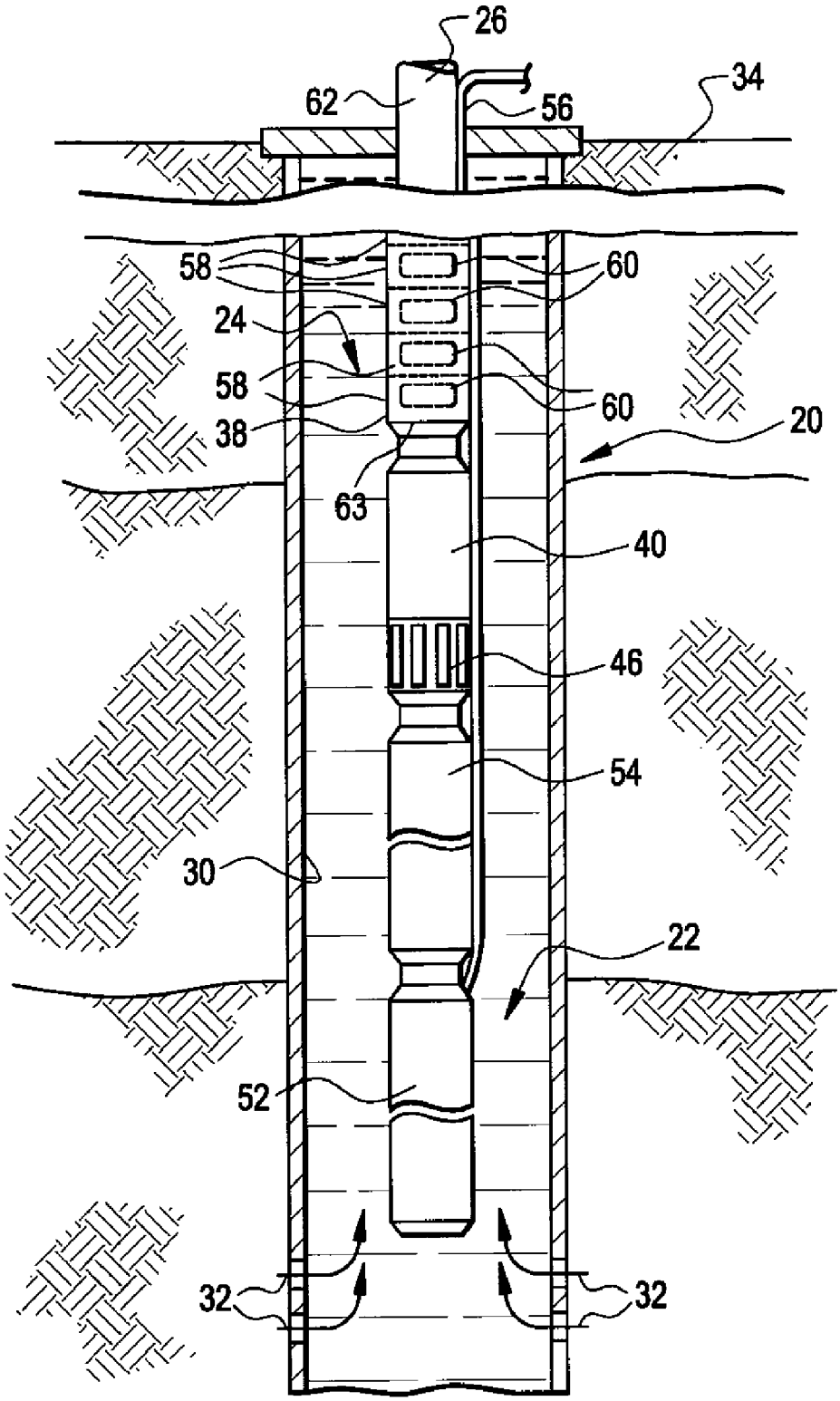
FIG. 2 is a front elevation view of another embodiment of a pumping system deployed in a wellbore, according to an embodiment of the present invention.

Referring generally to FIG. 2, one embodiment of pumping system 24 is illustrated in greater detail. In this embodiment, pumping system 24 comprises an electric submersible pumping system in which submersible pump 38 is a centrifugal type pump powered by a submersible motor 52. Submersible motor 52 may drive submersible pump 38 via a drive shaft extending through, for example, a motor protector 54 and mixer 40. Electric power is provided to submersible motor 52 via a power cable 56 that extends down along well system 20 from surface 34. In this type of embodiment, submersible pump 38 comprises a plurality of stages 58 stacked on top of one another, as illustrated by dashed lines in FIG. 2. Each stage 58 comprises an impeller 60, and the multiple impellers 60 are rotated by submersible motor 52 to move well fluid up through wellbore 22 to a desired collection location. The well fluid can be produced, for example, through a tubing 62 or through the surrounding annulus.

Dedicated mixer 40 is deployed upstream of the pumping components, e.g. impellers 60, to deliver a well mixed, homogeneous fluid to an inlet 63 of submersible pump 38. The configuration of dedicated mixer 40 and its placement upstream of the pumping components enables the use of conventional submersible pumps without altering the impeller angles, forming holes through the impellers, or using other pump manipulation techniques that can increase the cost and reduce the pumping efficiency of the overall system. In one embodiment, dedicated mixer 40 is formed as a separable component that is simply bolted into the electric submersible pumping system between, for example, submersible pump 38 and motor protector 54.

Figure 3:
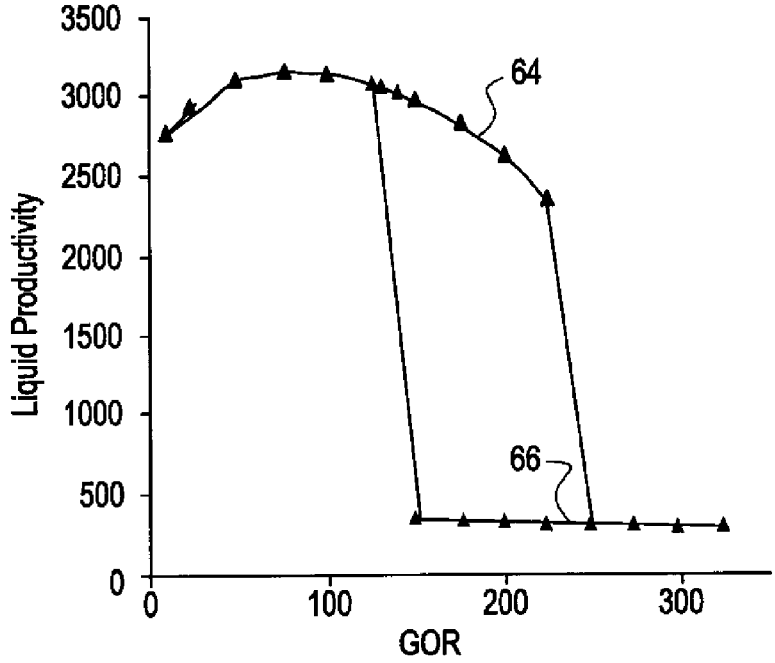
FIG. 3 is a graphical representation of stable, high and low productivity states between which a pumping system can transition when a mixer is not incorporated into the design as illustrated in the examples of FIGS. 1 and 2.

Without mixer 40, pumping system 24 is susceptible to the buildup of the gas on the suction side of impellers 60 which can lead to premature stalling of individual stages 58. Furthermore, without dedicated mixer 40, the well system is capable of operating in multiple stable states, as illustrated in FIG. 3. Transitions between the states can be triggered by flow transients, e.g. flow instabilities or perturbations. As illustrated in FIG. 3, a given pumping system without mixer 40 can operate at high liquid productivity states 64 or at low liquid productivity states 66 when pumping fluid having the same GOR rating, e.g. a GOR rating of 200 in the example provided in FIG. 3. The addition of mixer 40 enables gas structures within mixer 40 and/or surrounding mixer 40 to be minimized to an extent that operation of the overall pumping system 24 is not subjected to stalling of stages or transition between high and low productivity states. The dedicated mixer 40 homogenizes the mixture of liquid and gas phases prior to entry into submersible pump 38 and thus mitigates flow fluctuations at the inlet of submersible pump 38. Accordingly, the production of fluid can be maintained at the high liquid productivity rate 64, and the overall efficiency of the system 20 is dramatically increased.

Figure 4:
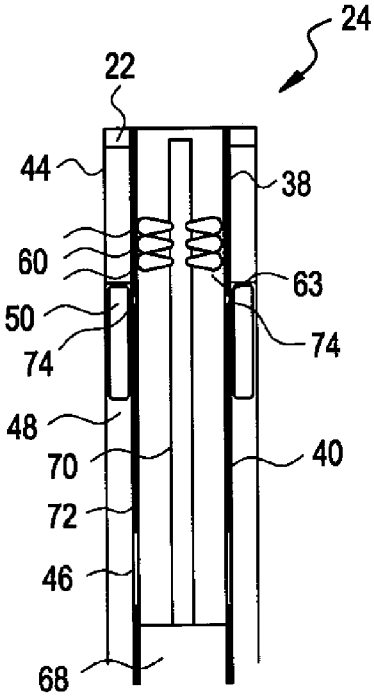
FIG. 4 illustrates one example of a mixer that can be incorporated into pumping systems as illustrated in FIGS. 1 and 2, according to an embodiment of the present invention.
Figure 5:
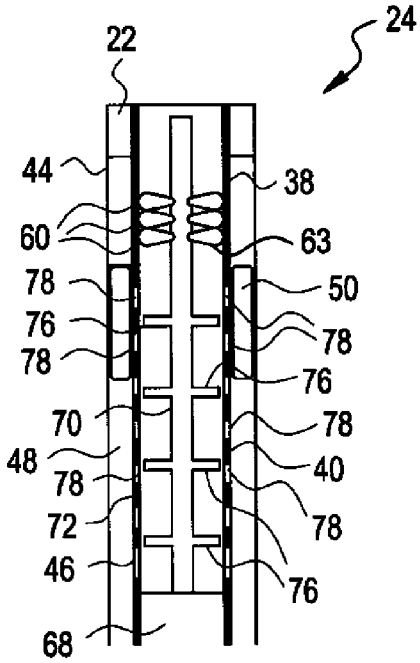
FIG. 5 illustrates another example of a mixer that can be incorporated into pumping systems as illustrated in FIGS. 1 and 2, according to an embodiment of the present invention.

Examples of dedicated mixers 40 are illustrated in FIGS. 4 and 5. Referring first to FIG. 4, dedicated mixer 40 is positioned between submersible pump 38 and a motive unit 68 that may comprise, for example, motor 52 and motor protector 54. Motive unit 68 drives a plurality of impellers 60 positioned in stages of pump 38. Specifically, the impellers 60 are rotated via a drive shaft 70 that extends through a mixer body 72 of dedicated mixer 40.

The dedicated mixer 40 illustrated in FIG. 4 is designed to capture relatively large gas structures 50 that accumulate in the annulus 48 surrounding mixer body 72. The gas structures 50 tend to form as well fluid is drawn into dedicated mixer 40 through inlet region 46 and gas is separated from the fluid. The gas flows upwardly along annulus 48 and is trapped beneath packer 44. However, gas from gas structure 50 surrounding mixer body 72 is drawn into dedicated mixer 40 through one or more ports 74. Ports 74 extend through mixer body 72 to create a communication path between the interior of mixer body 72 and the surrounding annulus 48. As fluid moves upwardly through mixer 40 from inlet region 46, the flowing fluid creates a venturi effect that draws in gas from gas structure 50 through ports 74.

Gas drawn in through ports 74 is rigorously combined with the fluid flowing rapidly through the interior of mixer body 72 to provide a well mixed fluid prior to pumping of that fluid via impellers 60. Volumetric phase variations in the annulus are accommodated by the variable liquid level in annulus 48 while a relatively constant rate of gas flow is bled into mixer 40. Furthermore, the system is self stabilizing because as the liquid level in the annulus goes down, the pressure drop across ports 74 increases, thus increasing the gas flow rate through ports 74. Additionally, the shape, e.g. curvature, of the inside surface of mixer body 72 proximate ports 74 can be adjusted to create more or less of a venturi effect. By mixing gas from gas structure 50 into the produced fluid flow in a controlled manner before it can interfere with intake of well fluid through inlet region 46, detrimental impacts to pumping system 24 are removed and higher liquid productivity rates are maintained.

Another embodiment of dedicated mixer 40 is illustrated in FIG. 5. In this embodiment, the dedicated mixer 40 is designed to harness the difference in slip velocity between large gas structures and small bubble clouds. It is known that large gas structures slip relative to the liquid phase at relatively high speed. The large gas structures rise along the outside of mixer body 72 at a high rate. Simultaneously, a plurality of mixer elements 76 within mixer body 72 prevent internal formation of large gas structures; homogenize the fluid flow within mixer 40; and minimize phase slip before the fluid enters submersible pump 38.

As well fluid enters dedicated mixer 40, large gas structures rise along the outside of mixer body 72 at a high rate. A plurality of small inlet ports 78 are arranged along mixer body 72 to drain gas from the large gas structures, e.g. gas structure 50, and to distribute the gas along the interior of mixer body 72 where it is re-homogenized before being directed to submersible pump 38. In the embodiment illustrated, the small inlet ports 78 are distributed along the length of mixer body 72. This allows gas to be bled off from the gas pockets/slugs over an extended region as the gas slugs slip past the liquid phase in the annulus surrounding mixer 40. Phase slip is prevented inside dedicated mixer 40 due to the mixing of liquid and gas which redistributes the gas phase relative to the liquid phase prior to pumping of the fluid.

Mixer elements 76 may be stationary mixer elements that create a mixing motion as fluid flows through the interior of dedicated mixer 40. The energy of the flowing fluid effectively stirs or mixes the gas phase and liquid phase to create a homogeneous fluid that can be produced efficiently. Alternatively, mixer elements 76 can be dynamic mixer elements that move within mixer body 72 to create a mixing action that redistributes the gas relative to the liquid. By way of example, such dynamic mixer elements can be coupled to shaft 70 and rotated via the power provided by motive unit 68. The rotation of elements 76 prevents the formation of large bubbles and eliminates slip between the gas and liquid phases while creating a homogeneous fluid for delivery to submersible pump 38. In this example, the mixer elements provide a rigorous mixing action without a pumping action and present the mixed fluid to submersible pump 38 for movement upwardly along wellbore 22.

The specific components used in well system 20 can vary depending on the actual well application in which the system is used. Similarly, the specific configuration of dedicated mixer 40 can vary from one well application to another. For example, one or more dedicated mixers 40 can be incorporated into a variety of electric submersible pumping systems or other pumping systems susceptible to phase separation in high gas-to-liquid ratio fluids. Additionally, the fluid inlets, fluid ports and/or mixer elements can be changed to accommodate different applications or different pumping equipment.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for pumping fluid in a wellbore, comprising:

a submersible pump;

a mixer positioned upstream of the submersible pump, the mixer having a mixer body with at least one port positioned to drain gas from a surrounding gas structure within the wellbore; and the mixer body comprises a plurality of ports positioned along an axial length of the mixer body.

2. A method, comprising:

placing a dedicated gas-liquid mixer upstream of all submersible pumping components designed to move well fluid;

moving the dedicated gas-liquid mixer and the submersible pumping components to a desired wellbore location; and intaking well fluid into the dedicated gas-liquid mixer and flowing the well fluid past a plurality of stationery, internal mixing elements to reduce bubble size within the dedicated gas-liquid mixer.

3. The method as recited in claim 2, further comprising operating the dedicated gas-liquid mixer to mix a gas phase and a liquid phase prior to entry into the submersible pumping components.

* * * * *